US012410671B1

(12) United States Patent
Gong

(10) Patent No.: US 12,410,671 B1
(45) Date of Patent: Sep. 9, 2025

(54) WELLHEAD EQUIPMENT FOR DRILLING

(71) Applicant: Shanghai SUPWEE Co., Ltd., Shanghai (CN)

(72) Inventor: Dawei Gong, Shanghai (CN)

(73) Assignee: Shanghai SUPWEE Co., Ltd., Shanghai (CN)

( * ) Notice: Subject to any disclaimer, the term of this patent is extended or adjusted under 35 U.S.C. 154(b) by 0 days.

(21) Appl. No.: 18/740,372

(22) Filed: Jun. 11, 2024

(30) Foreign Application Priority Data

May 13, 2024 (CN) ..... 202410592805.3

(51) Int. Cl.
*E21B 33/035* (2006.01)
*E21B 33/043* (2006.01)

(52) U.S. Cl.
CPC ..... *E21B 33/035* (2013.01); *E21B 33/043* (2013.01)

(58) Field of Classification Search
CPC ..... E21B 33/035; E21B 33/043; E21B 41/08
See application file for complete search history.

(56) References Cited

U.S. PATENT DOCUMENTS 2,075,899 A * 4/1937 Humason ..... E21B 33/04 285/97
2,920,909 A * 1/1960 Allen ..... E21B 33/0422 285/123.8
3,137,348 A * 6/1964 Ahlstone ..... E21B 33/043 166/368
3,302,709 A * 2/1967 Postlewaite ..... E21B 41/10 175/7
3,322,192 A * 5/1967 Woelfel ..... E21B 33/035 166/368
3,353,595 A * 11/1967 Gruller ..... E21B 33/047 166/347
4,611,661 A * 9/1986 Hed ..... E21B 41/10 166/368
4,749,046 A * 6/1988 Gano ..... E21B 23/12 166/368
5,005,650 A * 4/1991 Hopper ..... E21B 41/10 405/195.1

(Continued)

FOREIGN PATENT DOCUMENTS

CN 114876398 A * 8/2022
CN 114876398 B * 5/2023

(Continued)

*Primary Examiner* — Jennifer H Gay
(74) *Attorney, Agent, or Firm* — Umberg Zipser LLP

(57) ABSTRACT

Provided is a wellhead equipment for drilling including a wellhead, a conductor string, a guide base plate, a casing hanger and a first casing string. The guide base plate includes a base plate body and a mounting cylinder fixedly arranged in the base plate body, a top end of the wellhead is positioned above the mounting cylinder and provided with an interface part, a bottom end of the wellhead is positioned below the mounting cylinder, the conductor string is positioned below the wellhead, the conductor string is fixedly connected and communicated with the wellhead, a support ring fixedly clamped with the mounting cylinder sleeves an outer wall of a part, positioned in the mounting cylinder, of the wellhead, the casing hanger is clamped in the wellhead, the first casing string is positioned below the casing hanger, and the first casing string is fixedly connected with the casing hanger.

8 Claims, 2 Drawing Sheets

(56) References Cited

U.S. PATENT DOCUMENTS

| | | | | | |
|---|---|---|---|---|---|
| 5,213,162 | A * | 5/1993 | Iato | E21B 33/0407 | 166/344 |
| 6,062,312 | A * | 5/2000 | Wilkins | E21B 23/04 | 166/360 |
| 6,394,194 | B1 * | 5/2002 | Queen | E21B 21/066 | 175/218 |
| 6,460,621 | B2 * | 10/2002 | Fenton | E21B 33/035 | 166/347 |
| 6,698,520 | B2 * | 3/2004 | Fenton | E21B 47/07 | 166/347 |
| 6,805,200 | B2 * | 10/2004 | DeBerry | E21B 7/12 | 166/347 |
| 2002/0070026 | A1 * | 6/2002 | Fenton | E21B 34/04 | 166/347 |
| 2003/0051878 | A1 * | 3/2003 | DeBerry | E21B 33/0353 | 166/348 |
| 2004/0262009 | A1 * | 12/2004 | DeBerry | E21B 33/0353 | 166/348 |
| 2021/0054723 | A1 * | 2/2021 | Jacobsen | E21B 7/12 | |

FOREIGN PATENT DOCUMENTS

| | | | | | |
|---|---|---|---|---|---|
| CN | 118309384 | A * | 7/2024 | | |
| CN | 118327507 | A * | 7/2024 | | |
| GB | 1260707 | A * | 1/1972 | E21B 33/035 | |
| GB | 2357100 | A * | 6/2001 | E21B 33/035 | |
| NO | 20180011 | A1 * | 7/2019 | | |
| NO | 20220252 | A1 * | 12/2022 | | |

* cited by examiner

WELLHEAD EQUIPMENT FOR DRILLING

CROSS-REFERENCE TO RELATED APPLICATION

This patent application claims the benefit and priority of Chinese Patent Application No. 202410592805.3 filed with the China National Intellectual Property Administration on May 13, 2024, the disclosure of which is incorporated by reference herein in its entirety as part of the present application.

TECHNICAL FIELD

The present disclosure relates to the technical field of offshore oil and gas development, in particular to a wellhead equipment for drilling.

BACKGROUND

With the vigorous development of offshore oil and gas resources, offshore oil drilling and well completion equipment has been continuously optimized and improved. Usually, various oil equipment manufacturers basically design and improve offshore oil drilling and well completion equipment according to relevant industry standards. However, the development cost of offshore oil and gas is generally high, and how to reduce the cost and improve the time efficiency is an urgent problem to be solved in the industry.

As shown in FIG. 3, the conventional wellhead equipment for drilling mainly includes a high-pressure wellhead 1001, a low-pressure wellhead 1002, a first-position casing hanger 1003 and a second-position casing hanger 1004. The high-pressure wellhead 1001 is mounted in the low-pressure wellhead 1002. A specific matching structure is arranged between the first-position casing hanger 1003 and a segment at a first position in the high-pressure wellhead 1001. A specific matching structure is arranged between the second-position casing hanger 1004 and a segment at a second position in the high-pressure wellhead 1001. When mounting, the first-position casing hanger 1003 can only be mounted at the first position in the high-pressure wellhead 1001, and the second-position casing hanger 1004 can only be mounted at the second position in the high-pressure wellhead 1001. If the casing at the first position is not lowered, it is necessary to add an position-occupying hanger to cooperate with the first-position casing hanger 1003. In addition, a first-position sealing assembly 1005 needs to be arranged between the first casing hanger 1003 and the segment at the first position in the high-pressure wellhead 1001, and a second-position sealing assembly 1006 needs to be arranged between the second-position casing hanger 1004 and the segment at the second position in the high-pressure wellhead 1001. The overall structure of the wellhead equipment is complex, and the required mounting procedures are complicated, so that a lot of time and operating materials are spent, resulting in great waste to the development of oil fields.

SUMMARY

The purpose of the present disclosure is to provide a wellhead equipment for drilling so as to solve the problems in the prior art and effectively reduce the drilling and well completion costs.

In order to achieve the purpose, the present disclosure provides the following scheme.

The present disclosure provides a wellhead equipment for drilling. The wellhead equipment for drilling includes a wellhead, a conductor string, a guide base plate, a casing hanger and a first casing string. The guide base plate includes a base plate body and a mounting cylinder fixedly arranged in a center of the base plate body, the wellhead penetrates through the mounting cylinder, a top end of the wellhead is positioned above the mounting cylinder and provided with an interface part configured for connecting with a well-control equipment, a bottom end of the wellhead is positioned below the mounting cylinder, the conductor string is positioned below the wellhead, a top end of the conductor string is fixedly connected and communicated with the bottom end of the wellhead, a support ring fixedly sleeves an outer wall of a part, positioned in the mounting cylinder, of the wellhead, the support ring is clamped with the mounting cylinder, the casing hanger is clamped in the wellhead, the first casing string is positioned below the casing hanger, and a top end of the first casing string is fixedly connected with a bottom end of the casing hanger.

Preferably, an outer wall of the support ring is provided with a support step, an inner wall of the mounting cylinder is provided with a first bearing step, and the first bearing step is capable of being attached to the support step to bear the support step.

Preferably, an outer wall of the casing hanger is provided with a sitting step, an inner wall of the wellhead is provided with a second bearing step, and the second bearing step is capable of being attached to the sitting step to bear the sitting step.

Preferably, the bottom end of the casing hanger is provided with a first connecting thread part, the top end of the first casing string is provided with a second connecting thread part, and the first connecting thread part is in threaded connection with the second connecting thread part.

Preferably, the wellhead equipment for drilling also includes a locking ring. An annular clamping groove is formed in an outer wall of the mounting cylinder, the locking ring is configured for sleeving the outer wall of the mounting cylinder, the locking ring is provided with a clamping part and a pressing part, the clamping part is capable of being embedded in the annular clamping groove, and the pressing part is configured for being pressed on a top step surface of the support ring.

Preferably, the wellhead equipment for drilling also includes four guide posts. The four guide posts are fixedly arranged at four corners of the guide base plate respectively, and a top end of each of the four guide posts is fixedly connected with a guide rope.

Preferably, the wellhead equipment for drilling also includes a metal seal ring. The metal seal ring is arranged on the top end of the wellhead.

Preferably, the wellhead equipment for drilling also includes a second casing string and a transition joint. The second casing string is positioned below the conductor string, a diameter of the second casing string is smaller than a diameter of the conductor string, the transition joint is positioned between the second casing string and the conductor string, one end of the transition joint has a diameter equal to the diameter of the conductor string, an other end of the transition joint has a diameter equal to the diameter of the second casing string, the other end of the transition joint is fixedly connected and communicated with a top end of the second casing string, and the one end of the transition joint is fixedly connected and communicated with a bottom end of the conductor string.

Preferably, the wellhead equipment for drilling also includes a sealing assembly. The sealing assembly is positioned between the wellhead and the casing hanger.

Compared with the prior art, the present disclosure has the following technical effects.

According to the wellhead equipment for drilling provided by the present disclosure, only two layers of casing structures remain integrally. A high-pressure wellhead is used at the butted position of an upper part of the wellhead equipment for drilling provided by the present disclosure and the well-control equipment. A lower part of the high-pressure wellhead is directly connected with the conductor string capable of supporting the wellhead. The guide base plate that can be used for guiding the well-control equipment is mounted on the outer side of the wellbore. The casing hanger directly clamped on the inner side of the wellbore is mounted on the inner side of the wellbore. The first casing string connected with the casing hanger is an oil-string casing string for oil and gas exploitation according to drilling design. The oil-string casing string can enter an oil and gas reservoir after drilling operations are completed to develop stratum oil and gas. The wellhead equipment for drilling is simple in structure and convenient to mount. The operating procedures of drilling operations can be effectively reduced, and the cost of the equipment is effectively saved. Moreover, the whole operation time efficiency is effectively improved, and the drilling and well completion costs are effectively reduced.

BRIEF DESCRIPTION OF THE DRAWINGS

To more clearly illustrate the present embodiment of the present disclosure or the technical scheme in the prior art, the following briefly introduces the accompanying drawings to be used in the present embodiment. Apparently, the accompanying drawings in the following description show merely some embodiments of the present disclosure, and those skilled in the art may still derive other drawings from these attached figures without creative efforts.

REFERENCE SIGNS

1 wellhead; 2 conductor string; 3 transition joint; 4 second casing string; 5 casing hanger; 6 guide base plate; 61 mounting cylinder; 7 guide post; 8 support ring; 9 locking ring; 91 clamping part; 92 pressing part; 10 annular clamping groove; 11 support step; 12 first bearing step; 13 top step surface; 14 sitting step; 15 second bearing step; 16 first connecting thread part; 17 second connecting thread part; 18 first casing string; 19 interface part; 20 metal seal ring; 21 locking bolt; 22 guide rope; 23 sealing assembly; 1001 high-pressure wellhead; 1002 low-pressure wellhead; 1003 first-position casing hanger; 1004 second-position casing hanger; 1005 first-position sealing assembly; and 1006 second-position sealing assembly.

DETAILED DESCRIPTION OF THE EMBODIMENTS

The following clearly and completely describes the technical scheme in the embodiments of the present disclosure with reference to the embodiments of the present disclosure. Apparently, the described embodiments are merely a part rather than all of the embodiments of the present disclosure. Based on the embodiment in the present disclosure, all other embodiments obtained by the ordinary person skilled in the art without creative effort belong to the scope of the present disclosure.

The objective of the present disclosure is to provide a wellhead equipment for drilling so as to solve the problems in the prior art and effectively reduce the drilling and well completion costs.

To make the foregoing objective, features and advantages of the present disclosure clearer and more comprehensible, the present disclosure is further described in detail below with reference to the accompanying drawings and specific embodiments.

Figure 1:
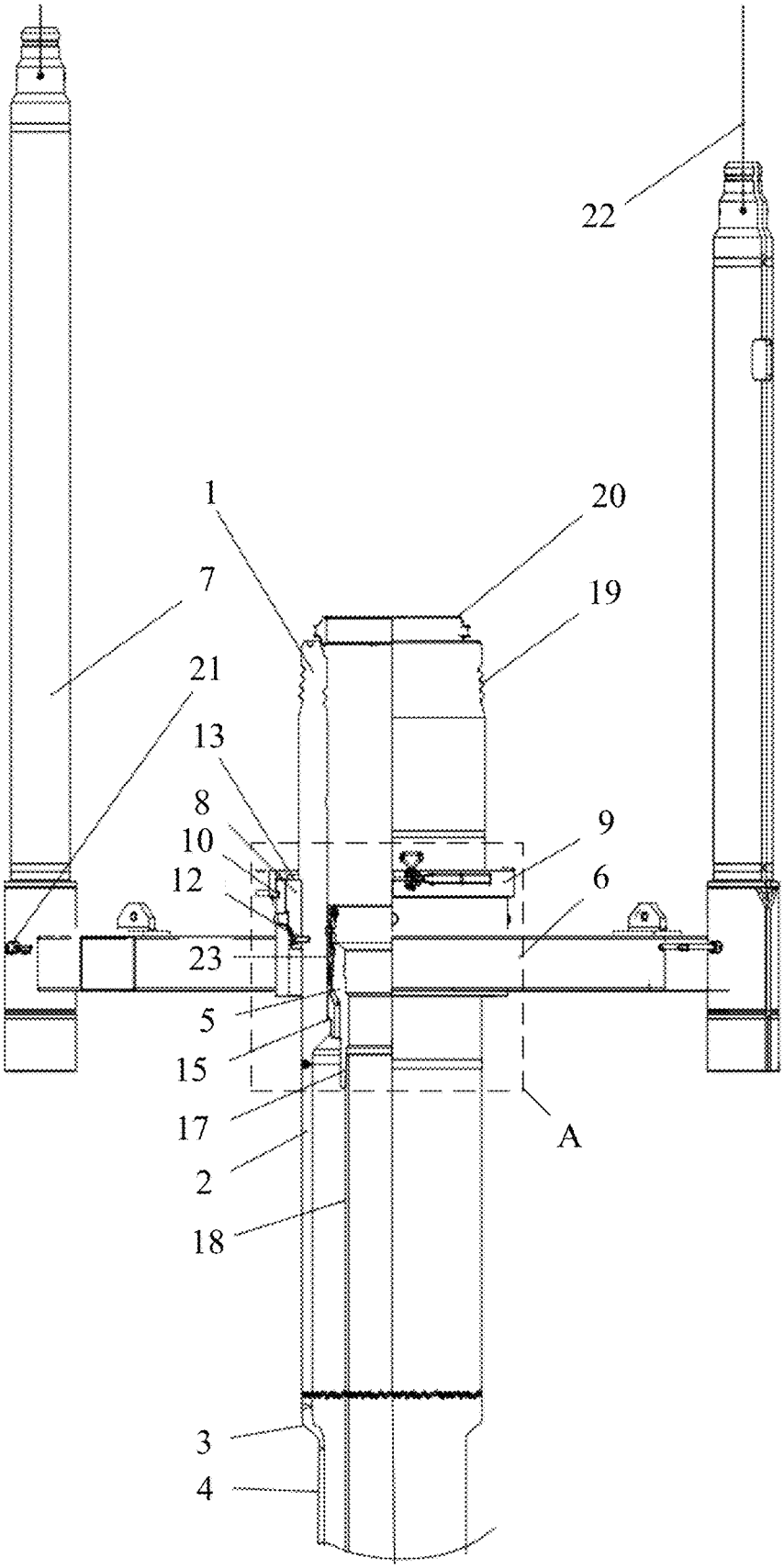
FIG. 1 is a schematic diagram of a wellhead equipment for drilling according to the present disclosure.
Figure 2:
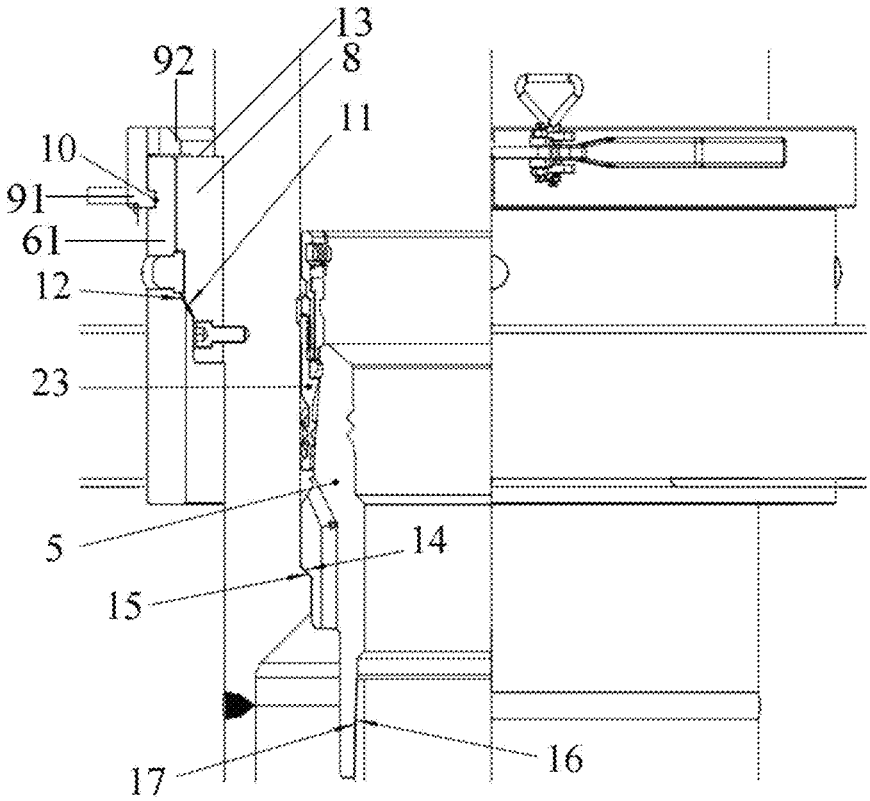
FIG. 2 is a partial enlarged view of region A in FIG. 1.
Figure 3:
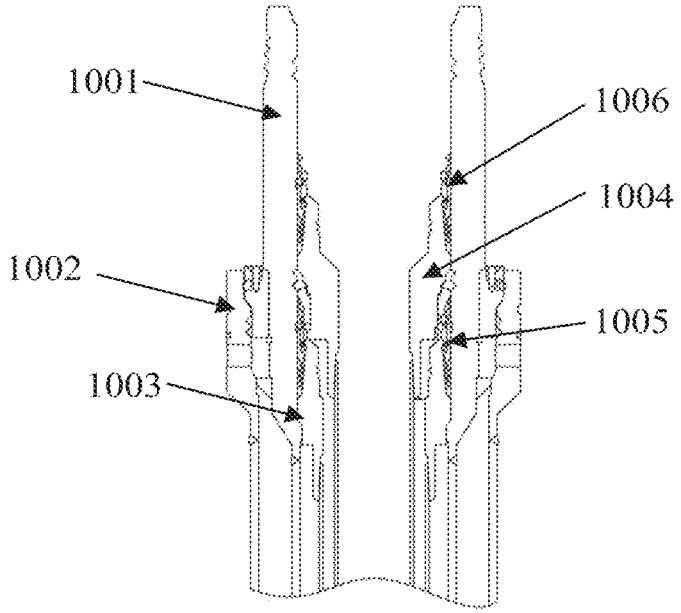
FIG. 3 Prior Art
FIG. 3 is a schematic diagram of a traditional wellhead in the prior art.

As shown in FIG. 1 and FIG. 2, a wellhead equipment for drilling is provided. The wellhead equipment for drilling includes a wellhead 1, a conductor string 2, a guide base plate 6, a casing hanger 5 and a first casing string 18. The guide base plate 6 includes a base plate body and a mounting cylinder 61 fixedly arranged in the center of the base plate body. The wellhead 1 penetrates through the mounting cylinder 61. A top end of the wellhead 1 is positioned above the mounting cylinder 61. The top end of the wellhead 1 is provided with an interface part 19 configured for connecting with a well-control equipment. A bottom end of the wellhead 1 is positioned below the mounting cylinder 61. The conductor string 2 is positioned below the wellhead 1. A top end of the conductor string 2 is fixedly connected and communicated with the bottom end of the wellhead 1. A support ring 8 fixedly sleeves an outer wall of the part, positioned in the mounting cylinder 61, of the wellhead 1. The support ring 8 is clamped with the mounting cylinder 61. The casing hanger 5 is clamped in the wellhead 1. The first casing string 18 is positioned below the casing hanger 5. A top end of the first casing string 18 is fixedly connected with a bottom end of the casing hanger 5.

According to the wellhead equipment for drilling of the present disclosure, only two layers of casing structures remain integrally. A high-pressure wellhead 1 is arranged at an upper part of, communicated with the well-control equipment, of the wellhead equipment for drilling of the present disclosure. A lower part of the high-pressure wellhead 1 is directly connected with the conductor string 2 capable of supporting the wellhead. The guide base plate 6 configured for guiding the well-control equipment is mounted on the outer side of the wellhead 1. The casing hanger 5 is directly clamped on the inner side of the wellhead 1. The first casing string 18 connected with the casing hanger 5 is a productive casing string for oil and gas exploitation according to drilling design and can enter into the oil and gas reservoir after drilling operations are completed, so as to develop formation oil and gas. The wellhead equipment for drilling is simple in structure and convenient to mount, which can effectively reduce the operating procedures of drilling operations and the cost of the equipment, and effectively improve the whole operation time efficiency, thus the drilling and well completion costs are effectively reduced. The wellhead equipment for drilling of the present disclosure can be applied in a wider field.

Furthermore, an outer wall of the support ring 8 is provided with a support step 11. An inner wall of the mounting cylinder 61 is provided with a first bearing step 12. The first bearing step 12 can be attached to the support step 11 to bear the support step 11, which is stable to facilitate operation and mounting.

Furthermore, an outer wall of the casing hanger 5 is provided with a sitting step 14. An inner wall of the wellhead 1 is provided with a second bearing step 15. The second bearing step 15 can be attached to the sitting step 14 to bear the sitting step 14, which is stable to facilitate operation and mounting.

Furthermore, the bottom end of the casing hanger 5 is provided with a first connecting thread part 16. The top end of the first casing string 18 is provided with a second connecting thread part 17. The first connecting thread part 16 is in threaded connection with the second connecting thread part 17, which is convenient to connect and disassemble and flexible to use.

Furthermore, the wellhead equipment for drilling of the present disclosure includes a locking ring 9. An annular clamping groove 10 is formed in an outer wall of the mounting cylinder 61. The locking ring 9 is configured for sleeving the outer wall of the mounting cylinder 61. The locking ring 9 is provided with a clamping part 91 and a pressing part 92. The clamping part 91 can be embedded in the annular clamping groove 10. The pressing part 92 is configured for being pressed on a top step surface 13 of the support ring 8, which can limit and fix the support ring 8 effectively to avoid the support ring 8 form moving upwards during the oil and gas exploitation.

Furthermore, the wellhead equipment for drilling of the present disclosure includes four guide posts 7 fixedly arranged at four corners of the guide base plate 6 respectively. A top end of each guide post 7 is fixedly connected with a guide rope 22. Firstly, the well-control equipment is guided initially by means of the guide ropes 22, so that the launch speed and efficiency of the well-control equipment are improved. Then, the well-control equipment is guided accurately by means of the guide posts 7, so that the launch accuracy of the well-control equipment is improved. As a preferred implementation of this embodiment, mounting holes are formed in four corners of the guide base plate 6, and each guide post 7 extends into each mounting hole, and each guide post 7 is locked in each mounting hole by a locking bolt 21.

Furthermore, the wellhead equipment for drilling of the present disclosure includes a metal seal ring 20. The metal seal ring 20 is arranged on the top end of the wellhead 1 so as to seal the joint of the wellhead 1 and the well-control equipment.

Furthermore, the wellhead equipment for drilling of the present disclosure includes a second casing string 4 and a transition joint 3. The second casing string 4 is positioned below the conductor string 2. The diameter of the second casing string 4 is smaller than that of the conductor string 2. The transition joint 3 is positioned between the second casing string 4 and the conductor string 2. One end of the transition joint 3 has a diameter equal to the diameter of the conductor string 2, and an other end of the transition joint 3 has a diameter equal to the diameter of the second casing string 4. The other end of the transition joint 3 is fixedly connected and communicated with a top end of the second casing string 4. The one end of the transition joint 3 is fixedly connected and communicated with a bottom end of the conductor string 2. The lower part of the conductor string 2 is connected with the transition joint 3 having changing diameter, so as to connect with the small second casing string 4.

Furthermore, the wellhead equipment for drilling of the present disclosure includes a sealing assembly 23. The sealing assembly 23 is positioned between the wellhead 1 and the casing hanger 5, so as to seal the joint of the wellhead 1 and the casing hanger 5.

Specific examples are used for illustration of the principles and implementation of the present disclosure. The description of the above-mentioned embodiments is used to help illustrate the method and its core principles of the present disclosure. In addition, those skilled in the art can make various modifications in terms of specific embodiments and scope of application in accordance with the teachings of the present disclosure. In summary, the contents of this specification should not be understood as the limitation of the present disclosure.

What is claimed is:

1. A wellhead equipment for drilling, comprising a wellhead, a conductor string, a guide base plate, a casing hanger, a first casing string and a locking ring, wherein the guide base plate comprises a base plate body and a mounting cylinder fixedly arranged in a center of the base plate body, the wellhead penetrates through the mounting cylinder, a top end of the wellhead is positioned above the mounting cylinder and provided with an interface part, a bottom end of the wellhead is positioned below the mounting cylinder, the conductor string is positioned below the wellhead, a top end of the conductor string is fixedly connected and communicated with the bottom end of the wellhead, a support ring supports an outer wall of a part of the wellhead positioned in the mounting cylinder, the support ring is secured with the mounting cylinder, the casing hanger is secured in the wellhead, the first casing string is positioned below the casing hanger, and a top end of the first casing string is fixedly connected with a bottom end of the casing hanger, wherein an annular clamping groove is formed in an outer wall of the mounting cylinder, the locking ring is configured for supporting the outer wall of the mounting cylinder, the locking ring is provided with a clamping part and a pressing part, the clamping part is capable of being embedded in the annular clamping groove, and the pressing part is configured for being pressed on a top step surface of the support ring.

2. The wellhead equipment for drilling according to claim 1, wherein an outer wall of the support ring is provided with a support step, an inner wall of the mounting cylinder is provided with a first bearing step, and the first bearing step is capable of being attached to the support step to bear the support step.

3. The wellhead equipment for drilling according to claim 2, wherein an outer wall of the casing hanger is provided with a sitting step, an inner wall of the wellhead is provided with a second bearing step, and the second bearing step is capable of being attached to the sitting step to bear the sitting step.

4. The wellhead equipment for drilling according to claim 1, wherein the bottom end of the casing hanger is provided with a first connecting thread part, the top end of the first casing string is provided with a second connecting thread part, and the first connecting thread part is in threaded connection with the second connecting thread part.

5. The wellhead equipment for drilling according to claim 1, further comprising four guide posts, wherein the four guide posts are fixedly arranged at four corners of the guide base plate respectively, and a top end of each of the four guide posts is fixedly connected with a guide rope.

6. The wellhead equipment for drilling according to claim 1, further comprising a metal seal ring, wherein the metal seal ring is arranged on the top end of the wellhead.

7. The wellhead equipment for drilling according to claim 1, further comprising a second casing string and a transition joint, wherein the second casing string is positioned below the conductor string, a diameter of the second casing string is smaller than a diameter of the conductor string, the transition joint is positioned between the second casing string and the conductor string, one end of the transition joint has a diameter equal to the diameter of the conductor string, one other end of the transition joint has a diameter equal to the diameter of the second casing string, the other end of the transition joint is fixedly connected and communicated with a top end of the second casing string, and the one end of the transition joint is fixedly connected and communicated with a bottom end of the conductor string.

8. The wellhead equipment for drilling according to claim 1, further comprising a sealing assembly, wherein the sealing assembly is positioned between the wellhead and the casing hanger.

* * * * *